United States Patent [19]

Page, Jr.

[11] Patent Number: 4,734,189

[45] Date of Patent: Mar. 29, 1988

[54] APPARATUS FOR ASSISTING IN THE REMOVAL OF TRASH FROM SWIMMING POOLS

[75] Inventor: Cornelius D. Page, Jr., Lincolnton, N.C.

[73] Assignee: PPL, Inc., Lincolnton, N.C.

[21] Appl. No.: 943,652

[22] Filed: Dec. 17, 1986

[51] Int. Cl.[4] ..... E04H 2/20

[52] U.S. Cl. ..... 210/169; 210/241; 4/490; 4/510

[58] Field of Search ..... 210/169, 416.2, 232, 210/241, 242.1, 776, 242.3, 923; 15/1.7; 134/167 R; 4/490, 488, 510

[56] References Cited

U.S. PATENT DOCUMENTS

| | | | |
|---|---|---|---|
| 3,152,076 | 10/1964 | Kreutzer | 210/169 |
| 3,244,284 | 4/1966 | Shaffer | 4/510 |
| 3,774,767 | 11/1973 | Field | 210/169 |
| 3,822,789 | 7/1974 | Crisafulli | 210/923 |
| 4,068,327 | 1/1978 | Heinlein | 210/169 |
| 4,225,436 | 9/1980 | Csech | 210/169 |

*Primary Examiner*—Richard V. Fisher
*Assistant Examiner*—Coreen Y. Lee
*Attorney, Agent, or Firm*—Bell, Seltzer, Park & Gibson

[57] ABSTRACT

A deflector apparatus easily and quickly mounted in position relative to an inlet opening of a swimming pool skimmer to deflect water and surface trash into the inlet opening and including a planar deflector member, an extensible member adapted to be positioned in the inlet opening to mount the deflector apparatus thereof, and readily adjustable mounting means on the deflector member and extensible member for mounting the deflector member in any one of multiple operative positions and inoperative positions.

13 Claims, 7 Drawing Figures

APPARATUS FOR ASSISTING IN THE REMOVAL OF TRASH FROM SWIMMING POOLS

This invention relates generally to trash removal apparatus for swimming pools and more particularly to a deflector apparatus for assisting a swimming pool skimmer in removing trash from the surface of water in the swimming pool.

Modern swimming pools are almost universally equipped with filtration systems which, when operative, continually remove water from the swimming pool through inlet openings provided in the sides of the swimming pool. As the water is removed through these inlet openings, trash on the surface of the water in the swimming pool is also removed through the inlet openings and is subsequently filtered from the water which is then returned into the swimming pool. This filtration system creates a current which flows around the inner periphery of the pool and causes the water and surface trash to flow outwardly to be removed through the inlet openings. These devices are commonly referred to as skimmers.

While such skimmers will eventually remove surface trash from the entire surface of the swimming pool, only the water and surface trash immediately adjacent the periphery of the swimming pool is removed by the skimmer because the inlet openings are parallel to the current flow of water past the opening. Therefore, it often takes several hours for surface trash to move outwardly against the periphery of the swimming pool so that it can be removed by conventional skimmers.

It has been previously proposed that the efficiency of such skimmers may be increased by deflector devices which extend outwardly from the side of a pool at one or more of the inlet openings to the skimmer for deflecting surface trash and water into the inlet openings as the current causes such surface trash and water to flow past the inlet openings.

Disadvantages of such previously proposed deflector devices have been the fact that they are semi-permanently installed against the sidewall of the pool and that most occupy only a single angular position with respect to the inlet openings. With such semi-permanently installed deflector devices, potential hazards exist when the pool is in use if such deflector devices remain projecting outwardly into the swimming pool. While some of these previously proposed devices provide for removal of the deflector devices, these devices must be then stored or are easily lost or misplaced. Some of these prior devices do provide for angular adjustment, but even so, the mounting arrangements for such devices are complex and difficult to install and adjust.

With the foregoing in mind, it is an object of the present invention to provide a deflector apparatus for assisting in the removal of trash from the surface of water in a swimming pool which overcomes the foregoing disadvantages and deficiencies.

It is a more specific object of the present invention to provide a deflector apparatus which is easily and quickly installed in proper position with respect to the inlet opening of a skimmer and which is capable of angular adjustment with respect to the sidewall of the swimming pool so that it may be quickly and easily moved to an out of the way, non-hazardous position and to multiple operative positions.

The foregoing objects of the present invention are accomplished by an apparatus for assisting a skimmer in the removal of surface trash from a swimming pool, including an extensible mounting member which is readily positioned within the inlet opening to a skimmer and is then extensible to engage the top and bottom of the inlet opening to securely mount the extensible member within that opening. The apparatus of the present invention also includes a deflector member positionable within the swimming pool partly above and partly below the surface of the water for deflecting water and surface trash into the inlet opening of the swimming pool skimmer. The deflector member is mounted on the extensible member by mounting means which includes cooperable male and female members carried respectively by the extensible member and the deflector member which mate and hold the deflector member in proper position but are readily adjustable to vary the angular position of the deflector member with respect to the sidewall of the swimming pool.

DETAILED DESCRIPTION OF THE PREFERRED EMBODIMENTS

Figure 1:
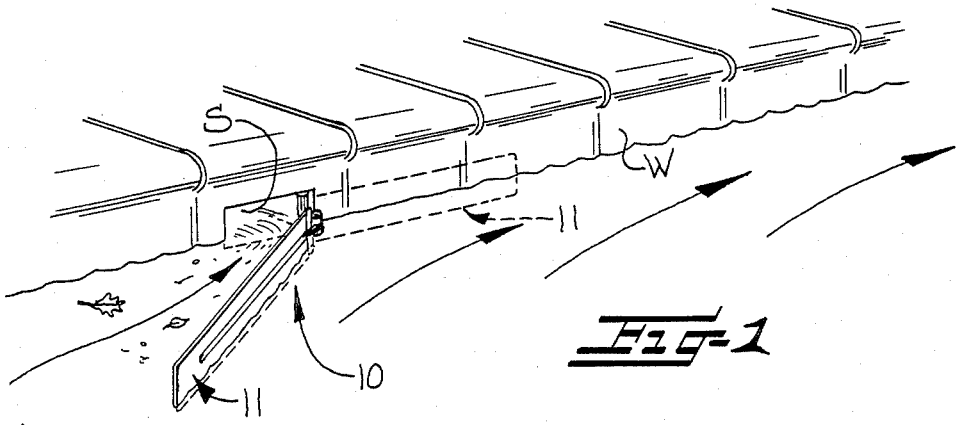
FIG. 1 is a fragmentary perspective view illustrating the apparatus of the present invention mounted in proper position relative to a skimmer opening in the sidewall of a swimming pool.

Referring now more specifically to the drawings and particularly to FIG. 1, the apparatus of the present invention is generally indicated at 10 and is shown mounted on the sidewall W of a swimming pool in proper position with respect to the inlet opening S to a skimmer (not shown). Apparatus 10 includes deflector means 11 for deflecting water and surface trash into the skimmer opening S in the sidewall W of a swimming pool.

Deflector means 11 comprises a deflector member 12 formed of suitable non-corrosive material, preferably high density molded plastic such as polypropylene. Deflector member 12 comprises a rectangular, relatively thin, planar member having a thickened reinforcing portion **12*a* at one end and vertically spaced apart reinforcing ribs 12*b* extending for a predetermined distance from the reinforcing end portion 12*a* toward the opposite end of deflector member 12. If deflector member 12 is formed of molded plastic, the reinforcing end portion 12*a* and ribs 12*b* can be formed integral with the remaining portions of deflector member 12** during the molding operation.

Figure 2:
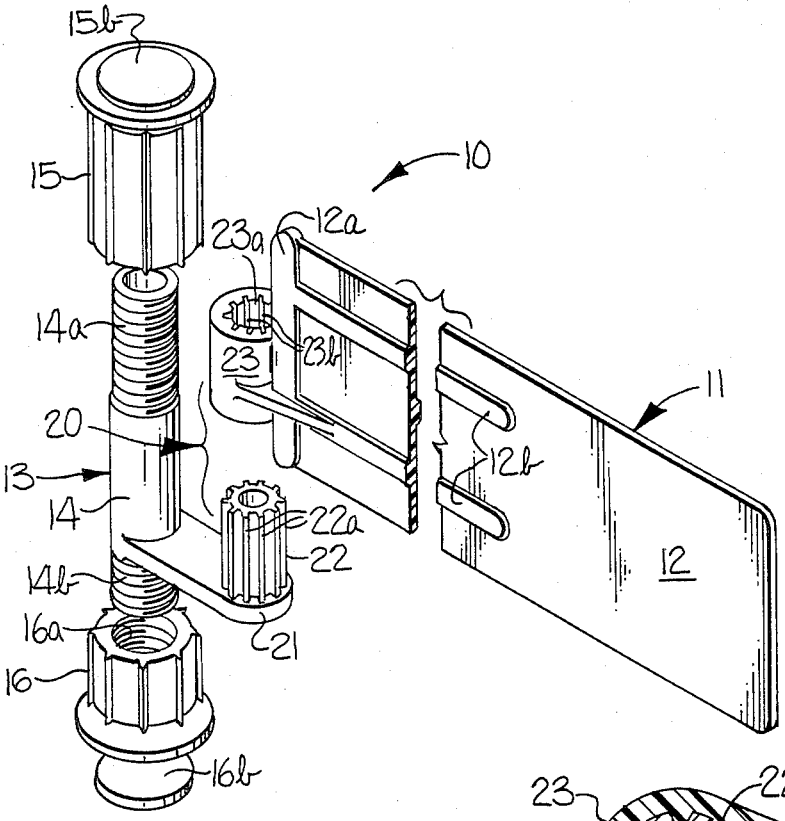
FIG. 2 is an exploded perspective view of one embodiment of the apparatus of the present invention.
Figure 4:
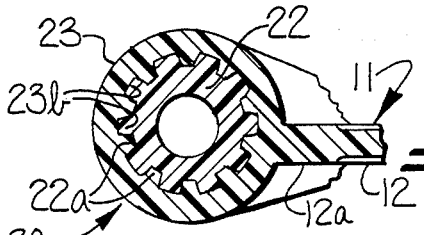
FIG. 4 is a fragmentary, enlarged sectional view taken substantially along line 4—4 in FIG. 3.
Figure 3:
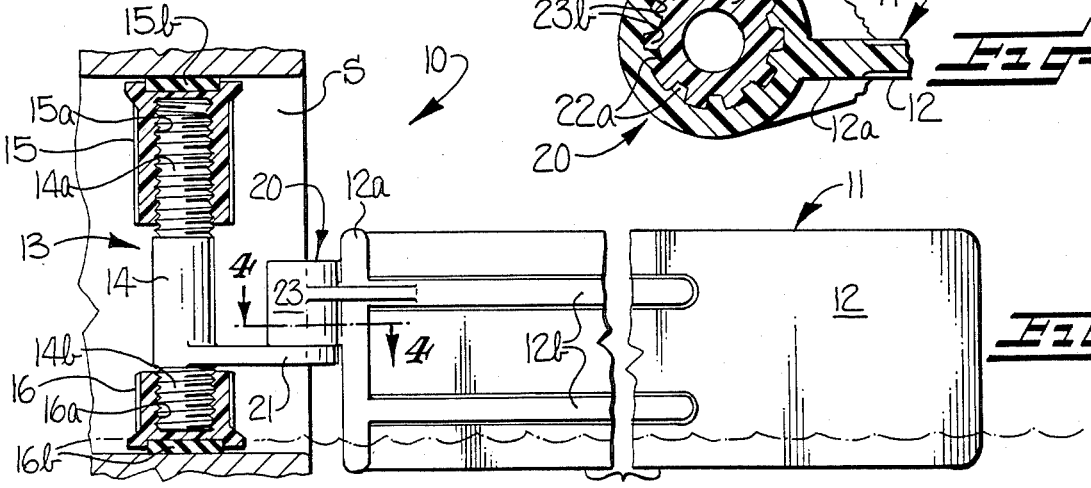
FIG. 3 is a fragmentary sectional view of the apparatus shown in FIG. 2.

In the embodiment illustrated in FIGS. 2–4, apparatus 10 further includes an extensible member 13 adapted to be positioned within the inlet opening S of the skimmer and to be firmly wedged therein. Extensible member 13 includes a shank portion 14 and opposite end cap portions 15 and 16. The shank portion 14 of extensible member 13 is externally threaded at its opposite ends 14*a* and 14*b*. Similarly, end caps 15 and 16 are internally threaded, as indicated at 15*a* and 16*a*, such that when end caps 15 and 16 are rotated relative to shank portion 14, the length of extensible member 13 is varied. Preferably, end caps 15 and 16 are provided with contact pads 15*b* and 16*b*, respectively, which are of a material having a high co-efficient of friction for increased frictional contact between the opposite ends of the extensible member 13 and the top and bottom of the skimmer openings.

Apparatus 10 further includes mounting means 20 for mounting said deflector means 11 on said extensible member 13 for adjustment between an inoperative position and several operative positions. As illustrated, mounting means 20 includes a mounting bracket 21 attached or integrally formed with the shank portion 14 of extensible member 13 and extending horizontally outwardly therefrom. A male mounting member 22 is carried by the outer end of mounting bracket 21. Mounting member 22 extends vertically upwardly from the outer end of mounting bracket 21 parallel to the shank portion 14 of extensible member 13, and has longitudinally extending splines 22*a* extending radially outwardly from the periphery thereof.

Mounting means 20 further includes a female mounting member 23, preferably integrally formed with the deflector member 12 at the end thereof having the reinforcing end portion 12*a*. Female mounting member 23 also extends vertically parallel to the longitudinal dimension of the reinforcing end portion 12*a*. Female mounting member 23 has a cooperating opening 23*a* extending vertically therethrough for receipt of male member 22 therein and which accordingly has a corresponding number and size of grooves 23*b* therein to mate with and receive the splines 22*a* on male member 22.

Female mounting member 23 is positioned in off-set relation to the longitudinal center line of deflector member 12 such that deflector member 12 may be mounted on male member 22 at two different heights. As seen in FIG. 2, the female mounting member 23 is below the center line of deflector member 12 which mounts deflector member 12 in the high water position. In FIG. 3, deflector member 12 and female mounting member 23 have been flipped over and female mounting member 23 is above the center line and mounts deflector member 12 in the low water position.

Figure 5:
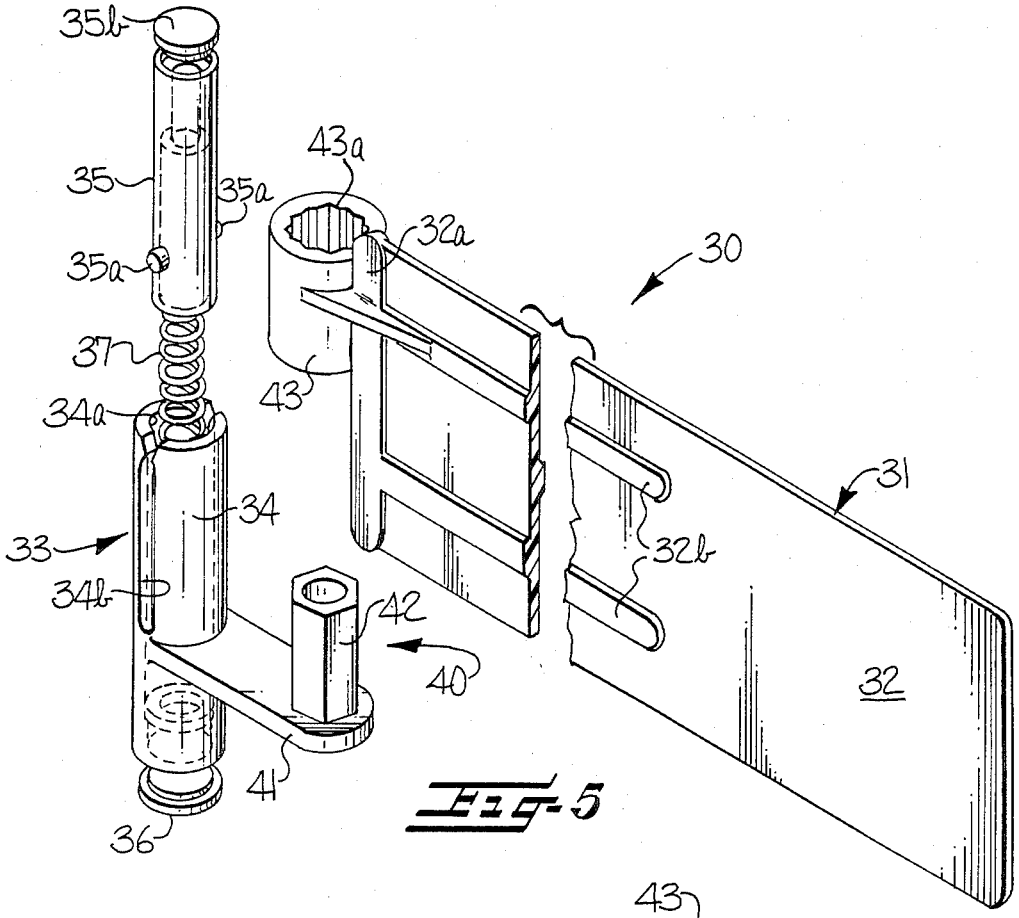
FIG. 5 is a view similar to FIG. 2 of another embodiment of the present invention.
Figure 7:
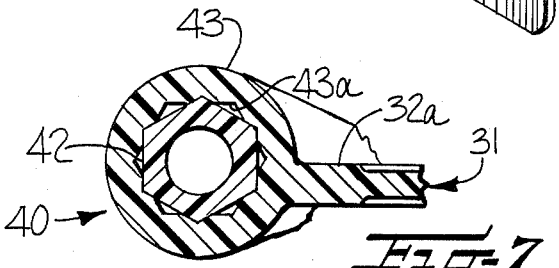
FIG. 7 is a fragmentary, enlarged sectional view taken substantially along line 7—7 in FIG. 6.
Figure 6:
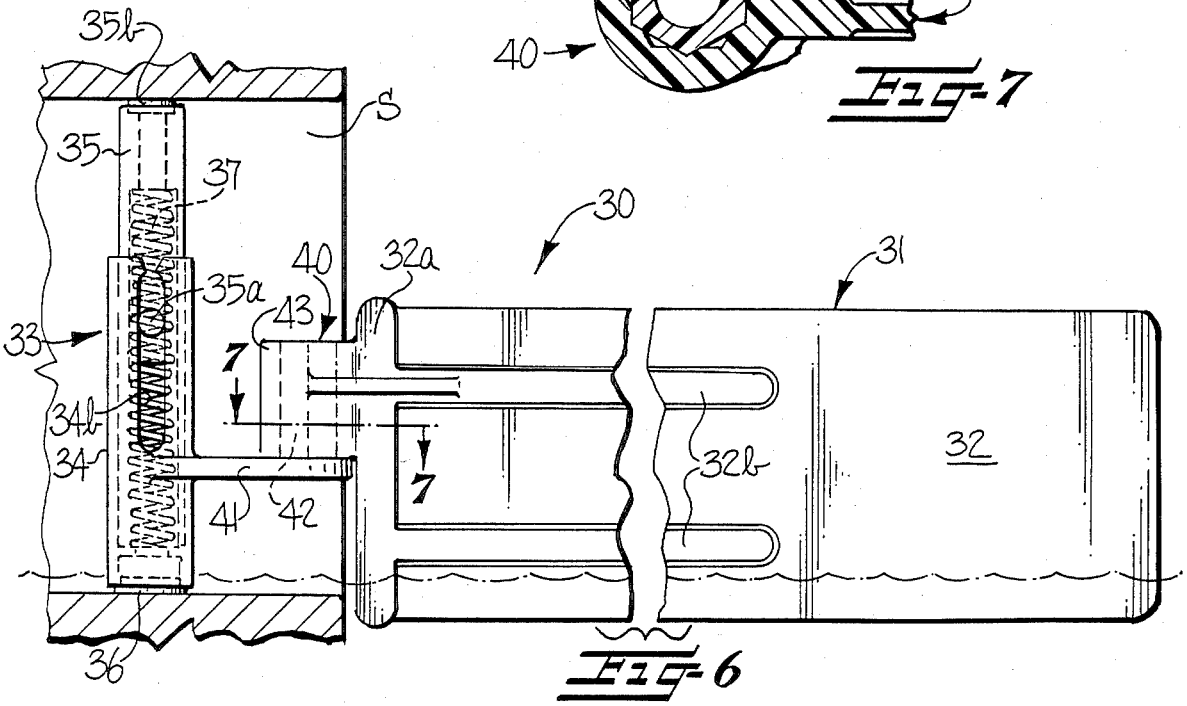
FIG. 6 is a view similar to FIG. 3 of the embodiment of the invention shown in FIG. 5.

In FIGS. 5–7, there is illustrated another embodiment of the apparatus of the present invention which is generally indicated at 30. As in the first embodiment, apparatus 30 includes deflector means 31 including a deflecting member 32 with reinforced end portion 32*a* and ribs 32*b*. Apparatus 30 also includes an extensible member 33 having a shank portion 34 and opposite end cap portions 35 and 36. Shank portion 34 is at least partially hollow with a bore 34*a* communicating with the upper end and extending downwardly for a predetermined distance in shank portion 34. Shank portion 34 has longitudinally extending slots 34*b* in opposite sides thereof with restrictive openings into the slots 34*b* at the upper ends thereof at the upper end of shank portion 34.

End cap portion 35 is adapted to be telescopically received within shank portion 34 and has bosses 35*a* thereon which are adapted to be received within slots 34*b* to guide end cap portion 35 in telescoping movement relative to shank portion 34 and to limit the outer extensive movement of the end cap portion 35 relative to shank portion 34.

Compression coil spring means 37 is positioned within shank portion 34 and end cap portion 35 to bias end cap portion 35 outwardly to its outermost extensible position relative to shank portion 34. As with previous extensible member 13, end cap portion 35 is provided with a contact pad 35*b* and end cap portion 36 is itself a contact pad of material having a high co-efficient of friction such that the opposite ends of extensible member 33 contact the top and bottom of the skimmer opening S with sufficient frictional engagement to firmly hold the extensible member 33 in position within the skimmer opening.

Apparatus 30 also includes mounting means 40 which includes an integrally formed mounting bracket 41 on shank portion 34 which extends horizontally outwardly therefrom. A male mounting member 42 is carried by and extends vertically upwardly from the outer end of mounting bracket 41 parallel to the shank portion 34. Preferably, male member 42 has an external hexagonal shape, but it should be understood that the external configuration of mounting member 42 may be any suitable geometric configuration which will permit adjustment of the angular position of the deflector member 32 relative to the sidewall W of the swimming pool while securely holding the deflector member in the adjusted position once it is so disposed, such as for example a polygonal configuration.

Mounting means 40 includes a female mounting member 43 integrally formed with the inner end of deflector member 32 off-set with respect to the longitudinal center line of deflector member 32 and which has an opening 43*a* therethrough for matingly receiving the male member 42 therein. The shape of the opening 43*a* through female mounting member 43 is preferably a 12 point shape similar to the shape of a socket end wrench which will permit the deflector member 32 to be positioned in up to 12 different angular orientations with respect to the male member 42.

Female mounting member 43 will mount deflector member 32 in high and low water positions in the same manner as female mounting member 23 mounts deflector member 12. While deflector member 32 is only shown in the low water position, it is only necessary to flip the deflector member 32 over to mount it in the high water position.

In operation, apparatus 10 may be quickly and easily mounted in proper position with respect to the inlet opening S of the skimmer in the sidewall W of the swimming pool by shortening the length of extensible member 13 or 33. With the first embodiment of this invention, the extensible member 13 may be shortened by simply rotating the end cap portions 15 and 16 in the appropriate direction so as to move them toward each other on the externally threaded end portions 14*a* and 14*b* of the shank portion 14. The extensible member 13 is then positioned within the skimmer opening S at the downstream end thereof with respect to the direction of the current in the swimming pool. The end cap portions 15 and 16 are then rotated in the opposite direction to move the same apart with respect to the shank portion 14 until the contact pads 15*b* and 16*b* thereon firmly engage the top and bottom of the skimmer opening such that the extensible member 13 is securely wedged within the skimmer opening.

The deflector means 11 may then be positioned in the desired angular orientation with respect to the sidewall W of the swimming pool and at the desired water height position by simply orienting the female mounting member 23 where it is on the upper or lower side of the center line of the deflector member 12 and then positioning the female member 23 over the male member 22 with the splines 22*a* on the male member received within the grooves 23*b* of the female mounting member 23. The deflector member 12 will thus be securely held in this desired angular position with respect to the sidewall W of the swimming pool so long as the deflector apparatus 10 is in use. When it is desired to move the deflector means to an inoperative position, it is only necessary to lift upwardly on the deflector means 11 to remove the same from the male mounting member 22 rotate the deflector means 11 until the deflector member 12 lies flush against the sidewall of the swimming pool and then drop the female mounting member 23 over the male mounting member 22 in this position as is shown in the dotted lines in FIG. 1. Also, the deflector member 12 may be removed entirely, and male member 22 move to an inoperative, safe position by rotating shank portion 14 relative to end caps 15 and 16 to position male member 22 wholly within the skimmer opening S.

The second embodiment of the present invention operates very similarly to the first embodiment except that the extensible member 33 may be shortened simply by pressing the end cap portion 35 inwardly with respect to the shank portion 34 against the biasing action of spring means 37. Once the extensible member 33 is positioned within the skimmer opening, the end cap portion 35 can be released and the spring means 37 will force the end cap portion 35 into contact with the top wall and the end cap portion 36 into firm frictional engagement with the bottom of the skimmer opening to firmly wedge the extensible member 33 therein. The deflector means 31 may then be positioned in any of its desired positions in the same manner as with the first embodiment.

While this invention is described in terms of the preferred embodiments, various modifications and changes may be made with respect to the foregoing detailed description without departing from the spirit of the present invention or the scope of the following claims.

That which is claimed is:

1. Apparatus for assisting in the removal of trash from the surface of water in a swimming pool equipped with a skimmer including at least one skimmer opening having top and bottom walls in the side of the swimming pool at water level to permit the skimmer to withdraw water and surface trash from the swimming pool, said apparatus comprising (a) deflector means for deflecting water and surface trash into the skimmer opening in the side of the swimming pool, said deflector means comprising an elongate member having a thin planar portion adapted to extend into the swimming pool at an acute angle to the side of the swimming pool with a lower portion of the deflector member below the surface of the water and the remaining portion thereof above the suface of the water, (b) an extensible member positioned within the skimmer opening in the side wall of the swimming pool when in use with opposite ends of said extensible member contacting the top and bottom of the skimmer opening to securely hold said extensible member within the skimmer opening, and (c) mounting means on said extensible member and said deflector member for mounting said deflector member on said extensible member in proper angular position relative to the skimmer opening, said mounting means permitting adjustment of the angular position of said deflector member relative to the side of the swimming pool to deflect more or less water and surface trash into the skimmer opening or to position said deflector member in an inoperative, nonhazardous position against the sidewall of the swimming pool.

2. Apparatus as recited in Claim 1 wherein said extensible member comprises a shank member having at least one threaded end portion and at least one internally threaded end cap member mounting on said shank to provide longitudinal extensible and retractable movement along the threaded end portion.

3. Apparatus as recited in claim 1 wherein said extensible member comprises a plurality of movable portions and means for biasing the movable portions toward an extended position.

4. Apparatus as recited in claim 1 wherein said mounting means on said extensible member and said deflector member comprises mating male and female members having cooperating locking portions which prevent relative rotation of the members to lock said deflector member in a selected angular position relative to the sidewall of the swimming pool.

5. Apparatus as recited in claim 4 wherein said cooperating locking portions comprise splines on one of said male and female members and spline receiving grooves on the other of said male and female members.

6. Apparatus as recited in claim 4 wherein said cooperating locking portions comprise a predetermined polygonal shape on said male member and a concomitant polygonal shape of the opening in said female member.

7. Apparatus for assisting in the removal of trash from the surface of water in a swimming pool equipped with a skimmer including at least one skimmer opening having top and bottom walls in the side of the swimming pool at water level to permit the skimmer to withdraw water and surface trash from the swimming pool, said apparatus comprising (a) deflector means for deflecting water and surface trash into the skimmer opening in the side of the swimming pool, said deflector means comprising an elongate member having a thin planar portion adapted to extend into the swimming pool at an acute angle to the side of the swimming pool with a lower portion of the deflector member below the surface of the water and the remaining portion thereof above the surface of the water, (b) an extensible member positioned within the skimmer opening in the side wall of the swimming pool when in use with opposite ends of said extensible member contacting the top and bottom of the skimmer opening to securely hold said extensible member within the skimmer opening, said extensible member comprising a shank member having at least one threaded end portion and at least one internally threaded end cap member mounted on said shank member for longitudinal extensible and retractable movement along the threaded end portion, and (c) mounting means on said extensible member and said deflector member for mounting said deflector member on said extensible member in proper angular position relative to the skimmer opening, said mounting means permitting adjustment of the angular position of said deflector member relative to the side of the swimming pool to deflect more or less water and surface trash into the skimmer opening or to position said deflector member in an inoperative, nonhazardous position against the sidewall of the swimming pool.

8. Apparatus according to claim 7 wherein said deflector member, extensible member and mounting means are formed of molded plastic material.

9. Apparatus according to claim 7 wherein contact pads of material having a high coefficient of friction are mounted on opposite ends of said extensible member.

10. Apparatus according to claim 7 wherein said shank member has opposite end portions thereof threaded and internally threaded end cap members are mounted on said opposite end portions.

11. Apparatus of assisting in the removal of trash from the surface of water in a swimming pool equipped with a skimmer including at least one skimmer opening having top and bottom walls in the side of the swimming pool at water level to permit the skimmer to withdraw water and surface trash from the swimming pool, said apparatus comprising (a) deflector means for deflecting water and surface trash into the skimmer opening in the side of the swimming pool, said deflector means comprising an elongate member having a thin planar portion adapted to extend into the swimming pool at an acute angle to the side of the swimming pool with a lower portion of the deflector member below the surface of the water and the remaining portion thereof above the surface of the water, (b) an extensible member positioned within the skimmer opening in the side wall of the swimming pool when in use with opposite ends of extensible member contacting the top and bottom of the skimmer opening to securely hold said extensible member within the skimmer opening, said extensible member comprising a shank member having an internal bore communicating with one end thereof and extending toward the other end thereof for a predetermined distance, an end cap member telescopically mounted in said bore of said shank members for extensible and retractable movement relative thereto, biasing means mounted insaid bore of said shank member for biasing said end cap member toward its extended position, and retaining means on said shank and end cap members for limiting the extensible movement of said end cap member, and (c) mounting means on said extensible member and said deflector member for mounting said defletor member on said extensible member in proper angular position relatie to the skimmer opening, said mounting means permitting adjustment of the angular position of said defletor member relative to the side of the swimming pool to deflect more or less water and surface trash into the skimmer opening or to position said deflector member in an inoperative, nonhazardous position against the sidewall of the swimming pool.

12. Apparatus according to claim 11 wherein said deflector member, extensible member and mounting means are formed of molded plastic material.

13. Apparatus according to claim 11 wherein contact pads of material having a high coefficient of friction are mounted on opposite ends of said extensible member.

* * * * *